US009751324B2

(12) United States Patent
Ando

(10) Patent No.: US 9,751,324 B2
(45) **Date of Patent: *Sep. 5, 2017**

(54) RECORDING APPARATUS

(71) Applicant: SEIKO EPSON CORPORATION, Tokyo (JP)

(72) Inventor: Masaaki Ando, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/187,411

(22) Filed: Jun. 20, 2016

(65) Prior Publication Data

US 2016/0303865 A1 Oct. 20, 2016

Related U.S. Application Data

(63) Continuation of application No. 14/206,003, filed on Mar. 12, 2014, now Pat. No. 9,393,803.

(30) Foreign Application Priority Data

Mar. 21, 2013 (JP) ..... 2013-058426

(51) Int. Cl.
*B41J 2/19* (2006.01)
*B41J 2/21* (2006.01)
*B41J 11/00* (2006.01)

(52) U.S. Cl.
CPC . *B41J 2/19* (2013.01); *B41J 2/21* (2013.01); *B41J 11/002* (2013.01)

(58) Field of Classification Search
CPC ..... B41J 2/19; B41J 2/21; B41J 11/002
See application file for complete search history.

(56) References Cited

U.S. PATENT DOCUMENTS

| | | | |
|---|---|---|---|
| 4,340,895 | A | 7/1982 | Kikuchi |
| 5,341,162 | A | 8/1994 | Hermanson et al. |
| 6,059,405 | A | 5/2000 | Mochizuki et al. |
| 6,089,702 | A | 7/2000 | Hilton |

(Continued)

FOREIGN PATENT DOCUMENTS

| | | |
|---|---|---|
| EP | 2540509 | 1/2013 |
| JP | 2005-059476 | 3/2005 |

(Continued)

OTHER PUBLICATIONS

European Search Report for Application No. 14160421.5 dated Jun. 14, 2014.

*Primary Examiner* — Alessandro Amari
*Assistant Examiner* — Roger W Pisha, II
(74) *Attorney, Agent, or Firm* — Workman Nydegger

(57) ABSTRACT

A recording apparatus includes a discharge head which discharges a radiation curable ink to a recording medium, an ink container which stores the radiation curable ink to be supplied to the discharge head, an ink circulation flow path which is formed so that the radiation curable ink supplied from the ink container returns back to the ink container, and is connected to the discharge head, a degassing module which is provided in the middle of the ink circulation flow path, and a vacuum controller which controls the degree of vacuum of the degassing module, and the vacuum controller controls the degree of vacuum so that the degree of vacuum is −60 kPa to −20 kPa.

5 Claims, 4 Drawing Sheets

(56) References Cited

U.S. PATENT DOCUMENTS

| | | | | |
|---|---|---|---|---|
| 6,379,796 | B1 | 4/2002 | Uenishi et al. | |
| 6,447,679 | B1 | 9/2002 | Watari et al. | |
| 6,558,450 | B2 | 5/2003 | Sengupta et al. | |
| 7,416,294 | B2 | 8/2008 | Kojima | |
| 8,128,214 | B2 | 3/2012 | Fujimori | |
| 8,157,365 | B2 | 4/2012 | Wouters et al. | |
| 8,298,327 | B2 | 10/2012 | Benjamin et al. | |
| 8,529,032 | B2 | 9/2013 | Indorsky et al. | |
| 8,585,196 | B2 | 11/2013 | Murakami et al. | |
| 9,393,803 | B2 * | 7/2016 | Ando | B41J 2/19 |
| 2002/0085060 | A1 | 7/2002 | Usui et al. | |
| 2004/0055505 | A1 | 3/2004 | Lye et al. | |
| 2007/0052782 | A1 | 3/2007 | Lee | |
| 2008/0079792 | A1 | 4/2008 | Hirato | |
| 2008/0098928 | A1 * | 5/2008 | Oyanagi | B41J 11/002 106/31.13 |
| 2008/0273063 | A1 | 11/2008 | Wouters et al. | |
| 2009/0167829 | A1 | 7/2009 | Iijima | |
| 2013/0016166 | A1 | 1/2013 | Hayata | |
| 2013/0083099 | A1 | 4/2013 | Anno | |
| 2013/0286120 | A1 * | 10/2013 | Kobayashi | B41J 11/002 347/102 |
| 2014/0285596 | A1 | 9/2014 | Ando | |

FOREIGN PATENT DOCUMENTS

| | | |
|---|---|---|
| JP | 2009-262478 | 11/2009 |
| JP | 2010-069798 | 4/2010 |
| JP | 2011-235605 | 11/2011 |
| JP | 2013-01882 | 1/2013 |
| WO | 2006-120048 | 11/2006 |
| WO | 2011-136079 | 11/2011 |

* cited by examiner

FIG. 5

| THE DEGREE OF VACUUM (kPa) | AN AMOUNT OF DISSOLVED OXYGEN (ppm) | THE LIFETIME OF PUMP (TIME) |
|---|---|---|
| -85 | 4.7 | 200 |
| -60 | 6.2 | 2000 |
| -50 | 7.2 | 3000 |
| -40 | 8.1 | 10000 |
| -30 | 9.1 | – |
| -20 | 9.7 | – |
| -10 | 10.5 | – |
| 0 | 10.5 | – |

RECORDING APPARATUS

BACKGROUND

1. Technical Field

The present invention relates to a recording apparatus, more particularly to a recording apparatus which performs a recording using a radiation-curable ink.

2. Related Art

A recording apparatus which has a discharge head discharging a radiation curable ink such as a UV ink to a recording medium is already well known. The recording apparatus can include, for example, an ink jet printer using the UV ink.

In addition, the recording apparatus includes an ink container that stores a radiation curable ink to be supplied to a discharge head, and an ink circulation flow path that is formed so that the radiation curable ink supplied from an ink container returns back to the ink container, and is connected to the discharge head.

In order to suppress the occurrence of air bubbles in a radiation curable ink, there is a case where a degassing module for removing air from the radiation curable ink is provided in the middle of an ink circulation flow path described above. Then, in this case, a vacuum pump is connected to the degassing module, and the vacuum pump performs a role of causing the inside of the degassing module to be negative-pressured.

However, in an example of the related art, the degree of negative pressure (the degree of vacuum) in the degassing module is the degree of negative pressure (the degree of vacuum) based on the specifications (power) of the vacuum pump (that is, the degree of vacuum is not controlled). Then, there is a disadvantage that the lifetime of a component is shortened due to this.

SUMMARY

An advantage of some aspects of the invention is to improve the lifetime of a component.

According to an aspect of the invention, there is provided a recording apparatus, including a discharge head which discharges a radiation curable ink onto a recording medium, an ink container which stores the radiation curable ink to be supplied to the discharge head, an ink circulation flow path which is formed so that the radiation curable ink supplied from the ink container returns back to the ink container, and is connected to the discharge head, a degassing module which is provided in the middle of the ink circulation flow path, and a vacuum controller which controls the degree of vacuum of the degassing module, and in which the vacuum controller controls the degree of vacuum so that the degree of vacuum is −60 kPa to −20 kPa.

Other features of the invention will be disclosed by this description and accompanying drawings.

BRIEF DESCRIPTION OF THE DRAWINGS

Embodiments of the invention will now be described by way of example only with reference to the accompanying drawings, wherein like numbers reference like elements.

FIG. 5 is a diagram which shows relationships among the degree of vacuum, an amount of dissolved oxygen, and the lifetime of a pump.

DESCRIPTION OF EXEMPLARY EMBODIMENTS

By this description and accompanying drawings, at least the following will be disclosed.

According to an aspect of the invention, there is provided a recording apparatus, including a discharge head which discharges a radiation curable ink onto a recording medium, an ink container which stores the radiation curable ink to be supplied to the discharge head, an ink circulation flow path which is formed so that the radiation curable ink supplied from the ink container returns back to the ink container, and is connected to the discharge head, a degassing module which is provided in the middle of the ink circulation flow path, and a vacuum controller which controls the degree of vacuum of the degassing module, and in which the vacuum controller controls the degree of vacuum so that the degree of vacuum is −60 kPa to −20 kPa.

In this case, the recording apparatus can improve the lifetime of a component.

In the recording apparatus according to the aspect, when the degree of vacuum of the degassing module is smaller than −60 kPa, an amount of dissolved oxygen in the radiation curable ink may be less than 6 ppm.

In this case, by increasing an amount of dissolved oxygen to more than 6 ppm, the lifetime of a component can be improved.

In the recording apparatus according to the aspect, the radiation curable ink may be a radical polymerization-type ink.

In this case, by controlling the radical polymerization of the radical polymerization-type ink, the lifetime of a component can be improved.

In the recording apparatus according to the aspect, a polymerization inhibitor included in the radiation curable ink may be equal to or less than 500 ppm.

In this case, the effect of improving the lifetime of a component can be more effectively achieved.

In the recording apparatus according to the aspect, the polymerization inhibitor may be a hindered amine compound.

In this case, the effect of improving the lifetime of a component can be more effectively achieved.

In the recording apparatus according to the aspect, the radiation curable ink may be a black color ink or a yellow color ink.

In this case, the effect of improving the lifetime of a component can be more effectively achieved.

Schematic Configuration Example of Printer 1

Figure 1:
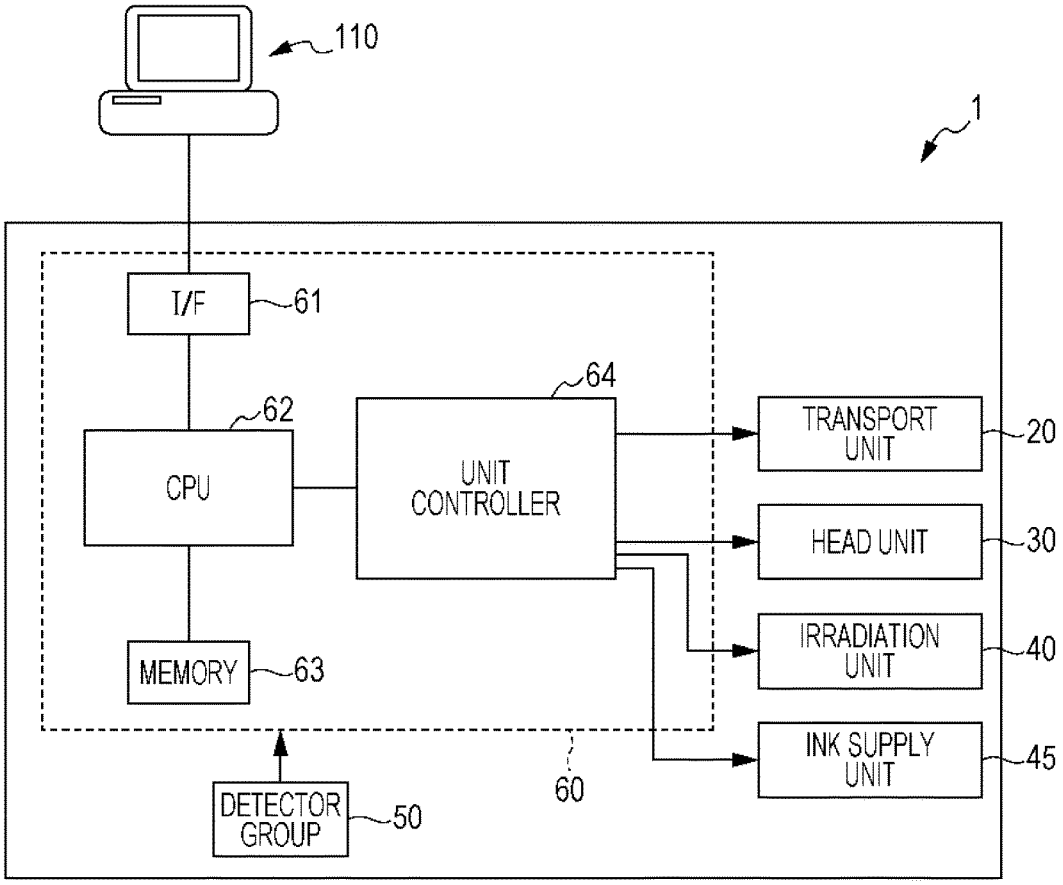
FIG. 1 is a block diagram of the entire configuration of a printer.
Figure 2:
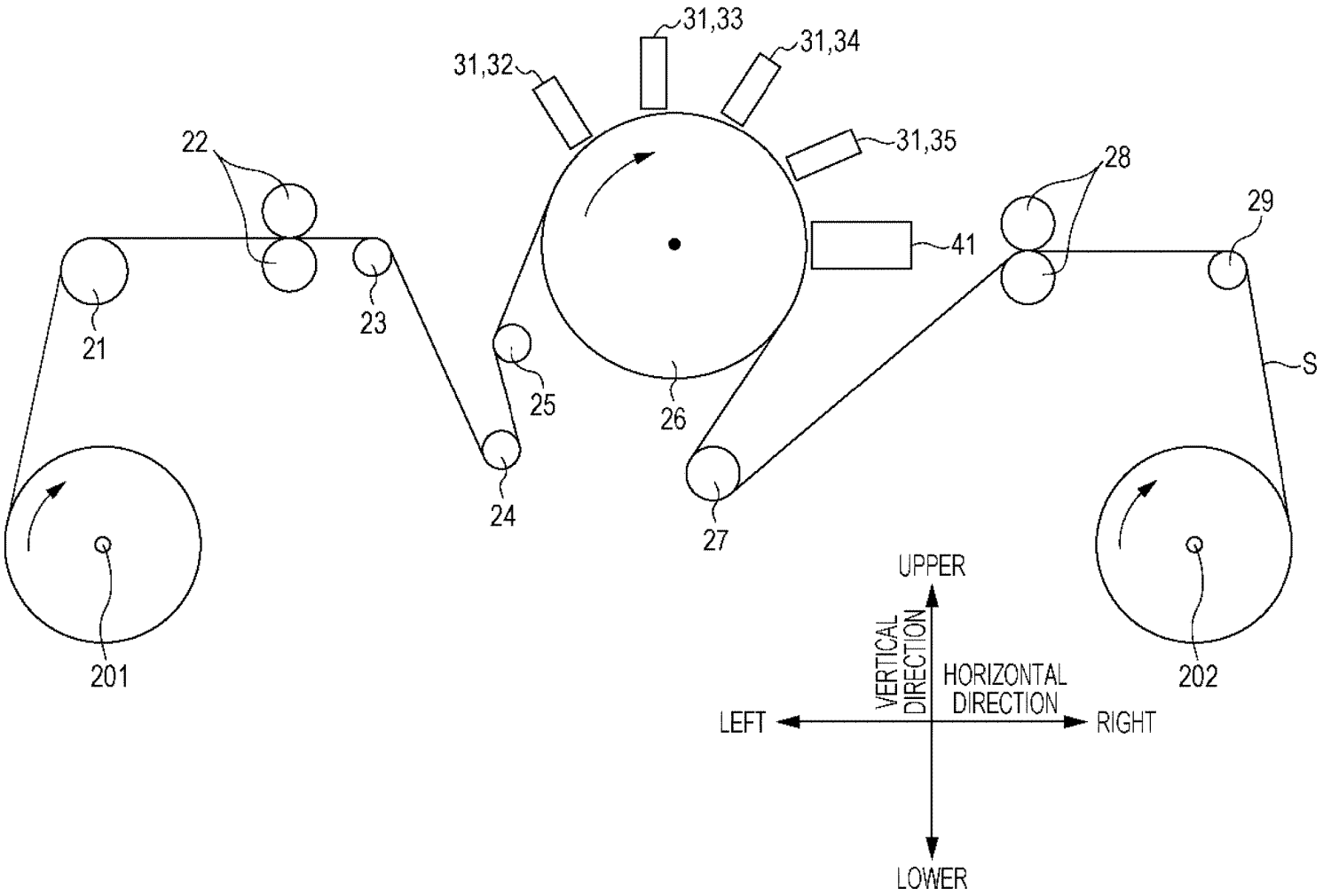
FIG. 2 is a schematic diagram of a transport path including a printing region.

FIG. 1 is a block diagram of the entire configuration of an ink jet printer (hereinafter, simply referred to as a printer 1) as an example of the recording apparatus. In addition, FIG. 2 is a schematic diagram of a transport path including in a printing region.

The printer 1 is a recording apparatus (a printing device printing an image) which records an image on a recording medium such as a sheet, cloth, and film, and is connected to be able to communicate with a computer 110 which is provided as an external device or an internal device. In the embodiment, a sheet (hereinafter, referred to as a roll sheet S (continuous sheet)) which is wound in a roll shape is used and described as an example of the recording medium on which the printer 1 records an image.

In the computer 110, a printer driver is installed. The printer driver is a program for displaying a user interface on a display device (not illustrated) and converting image data output from an application program into printing data. The printer driver is recorded in a recording medium (a computer-readable recording medium) such as a flexible disk FD, a CD-ROM, and the like. Alternatively, it is also possible to download the printer driver to the computer 110 through the internet. The program is configured from codes for realizing various types of functions.

Then, the computer 110 outputs printing data corresponding to an image to be printed to the printer 1 so as to print the image by the printer 1.

The printer in the embodiment is a device which prints an image onto a medium by discharging an ultraviolet curable ink (hereinafter, UV ink) which is cured by irradiating ultraviolet rays (hereinafter, UV) as an example of a radiation curable ink. The printer 1 in the embodiment prints an image using UV inks of four colors such as a cyan color, a magenta color, a yellow color, and a black color, but the invention is not limited thereto. The printer 1 may print an image using, for example, a white color ink or a clear ink. The UV inks will be described in detail later.

The printer 1 has a transport unit 20, a head unit 30, an irradiation unit 40, an ink supply unit 45, a detector group 50, and a controller 60. The printer 1 which receives printing data from the computer 110 which is an external device controls each unit (transport unit 20, head unit 30, irradiation unit 40, ink supply unit 45) using the controller 60 to print an image on a roll sheet S according to the printing data. The controller 60 controls each unit so as to print an image on the roll sheet S based on the printing data received from the computer 110. The conditions in the printer 1 are monitored by the detector group 50, and the detector group 50 outputs a result of detection to the controller 60. The controller 60 controls each unit based on the result of detection output from the detector group 50.

The transport unit 20 transports the roll sheet S along a transport path set in advance. The transport unit 20, as shown in FIG. 2, has a feed shaft 201 about which the roll sheet S is wound and rotatably supported, a relay roller 21, a first transport roller 22, a relay roller 23, a reverse roller 24, a contact roller 25, a transport drum 26, a tension roller 27, a second transport roller 28, a tension roller 29, and a roll sheet winding drive shaft 202 which winds the roll sheet S passing through the tension roller 29.

The transport drum 26 is a transport member of a cylindrical shape, supports the roll sheet S on the peripheral surface thereof and transports the roll sheet S in the transport direction. In addition, the transport drum 26 opposes each head 31 and each UV irradiation portion through the roll sheet S. Moreover, the roll sheet S is transported so as to be in close contact with the transport drum 26 with a predetermined tension.

Then, the roll sheet S moves successively through each roller, and thereby a transport path for transporting the roll sheet S is formed.

The head unit 30 discharges a UV ink onto the roll sheet S. The head unit 30 discharges the UV ink from each head 31 (corresponding to a discharge head) onto the roll sheet S which is being transported in the transport direction, thereby forming dots on the roll sheet S and printing an image on the roll sheet S.

Each head 31 of the head unit 30 of the printer 1 in the embodiment can form dots corresponding to the width of the roll sheet S, which is a medium, at a time. That is, the head 31 is so-called line head. Therefore, the head 31 has a long shape in a sheet width direction (the direction penetrating the sheet surface in FIG. 2) which is a direction intersecting with the transport direction, and nozzles are aligned in the sheet width direction. Then, the head 31 discharges the UV ink from the nozzles onto the roll sheet S transported by the transport unit 20 to successively (repeatedly) print raster lines (accordingly, a plurality of raster lines are aligned in the transport direction).

A piezo element (not illustrated) as a drive element for discharging the UV ink is provided in the nozzles. The piezo element, when applying a voltage to between electrodes provided at both ends thereof with predetermined time intervals, extends according to the time of applying the voltage to deform the side wall of the flow path of the UV ink. Accordingly, the volume of the flow path of an ink contracts according to the expansion and contraction of the piezo element, and the UV ink corresponding to the amount of contraction is discharged from a nozzle in ink droplets.

In addition, in the embodiment as described above, as the UV ink, UV inks of four colors for forming an image are used. As shown in FIG. 2, each head 31 of a cyan ink head 32 which discharges the UV ink of a cyan color, a magenta ink head 33 which discharges the UV ink of a magenta color, a yellow ink head 34 which discharges the UV ink of a yellow color, and a black ink head 35 which discharges the UV ink of a black color is provided successively from the upstream side in the transport direction so as to oppose the peripheral surface of the transport drum 26.

The ink supply unit 45, when an amount of the UV ink in the head unit 30 is reduced due to the discharge of the UV ink by the head 31, supplies the UV ink to the head unit 30. The ink supply unit 45 will be described in detail later.

The irradiation unit 40 irradiates UV rays towards a UV ink landed on a medium. Dots formed on the medium are cured by receiving the irradiation with the UV rays from the irradiation unit 40. The irradiation unit 40 in the embodiment includes an irradiation portion 41. The irradiation portion 41 includes a lamp (a metal halide lamp, a mercury lamp, and the like) or an LED as a light source of the UV irradiation.

The irradiation portion 41 is provided at a further downstream side in the transport direction with respect to the black ink head 35. In other words, the irradiation portion 41 is provided at the further downstream side in the transport direction with respect to the head unit 30. Then, the irradiation portion 41 irradiates the UV rays onto an image (dots) formed on the roll sheet S using the cyan ink head 32, the magenta ink head 33, the yellow ink head 34, and the black ink head 35 to obtain curing of the dots.

In the detector group 50, a pressure sensor and the like to be described later are included. The controller 60 is a control unit (controller) for performing the control of the printer 1. The controller 60 has an interface unit 61, a CPU 62, a memory 63, and a unit controller 64. The interface unit 61 transmits or receives data between the computer 110 which is an external device and the printer 1. The CPU 62 is an operation processing device for controlling the entire printer. The memory 63 is intended to secure a region for storing programs of the CPU 62, a work region, and the like, and includes a storage element such as RAM, EEPROM, and the like. The CPU 62 controls each unit through a unit controller 64 according to a program stored in the memory 63.

UV Ink

The UV ink is an ink including a UV curable resin, and is cured by a photo polymerization reaction occurring in the UV curable resin when receiving the irradiation with the UV rays. That is, the UV ink according to the embodiment is a radical polymerization-type ink (photo radical curable ink).

In the following, additives which are included or can be included in the ink composition in the embodiment will be described.

Thioxanthone Photo Polymerization Initiator

An ink composition in the embodiment includes a thioxanthone photo polymerization initiator which is excellent in solubility, safety, and cost properties. The thioxanthone photo polymerization initiator, by photo polymerization caused by the irradiation with the UV rays, cures an ink on the surface of a recording medium to be used for forming an image, and includes the thioxanthone photo polymerization initiator, and thereby it is possible to improve the curability of the ink composition. By using the UV rays (UV) among radiation, it is possible to have excellent safety and reduce the cost of the light source lamp.

The thioxanthone photo polymerization initiator is not particularly limited, but more specifically, is preferably those including one or more selected from a group of thioxanthone, diethylthioxanthone, isopropylthioxanthone, and chlorothioxanthone. There is no particular limitation, but 2,4-diethylthioxanthone is preferred as diethylthioxanthone, 2-isopropylthioxanthone is preferred as isopropylthioxanthone, and 2-chlorothioxanthone is preferred as chlorothioxanthone. The ink composition including the thioxanthone photo polymerization initiator tends to be more excellent in curability, storage stability, and discharge stability. Among these, a thioxanthone photo polymerization initiator including diethylthioxanthone is preferred. By including diethylthioxanthone, the thioxanthone photo polymerization initiator tends to convert the ultraviolet light (UV light) of a wide region into active species more efficiently.

A commercially available thioxanthone photo polymerization initiator is not particularly limited, but includes more specifically Speedcure DETX (2,4-diethylthioxanthone), Speedcure ITX (2-isopropylthioxanthone) (the above, manufactured by Lambson Inc.), and KAYACURE DETX-S (2,4-diethylthioxanthone) (manufactured by Nippon Kayaku Co., Ltd.).

The content of the thioxanthone photo polymerization initiator is preferably 0.5 to 4 mass %, and is more preferably 1 to 4 mass % with respect to the total mass (100 mass %) of the ink composition. When the content is equal to or more than 0.5 mass %, the thioxanthone photo polymerization initiator tends to be more excellent in the curability of an ink. In addition, when the content is equal to or less than 4 mass %, excellent discharge stability tends to be maintained more effectively. When the dissolved oxygen concentration of the ink composition is high during using the thioxanthone photo polymerization initiator, the reason why the discharge stability from a head significantly falls is presumed to be because the thioxanthone photo polymerization initiator is present as fine particles in the ink composition and accordingly the particles become bubble nuclei promoting the oxygen dissolved in the ink composition to appear as air bubbles in the storage of the ink composition. However, this is a presumption, and the reason is not limited thereto.

Other Photo Polymerization Initiators

The ink composition may further include other photo polymerization initiators, and these photo polymerization initiators may be used as well as or instead of the thioxanthone photo polymerization initiator. By using the UV rays (UV) among the radiation, it is possible to have excellent safety and reduce the cost of the light source lamp. Other photo polymerization initiators include an initiator, which generates the active species such as radicals and the like using energy of light (UV rays) to initiate the polymerization of a polymerizable compound, without limitation, however it is preferable to use a photo-radical polymerization initiator among them.

The photo-radical polymerization initiator is not particularly limited, but includes, for example, aromatic ketones, an acyl phosphine oxide compound, an aromatic onium salt compound, an organic peroxide, a thio compound (such as a thiophenyl group-containing compound and the like), an α-aminoalkylphenone compound, a hexaarylbiimidazole compound, a ketoxime ester compound, a borate compound, an azinium compound, a metallocene compound, an active ester compound, a compound having a carbon-halogen bond, and an alkylamine compound.

Among these, it is preferable to further include an acyl phosphine oxide-based photo polymerization initiator (acyl phosphine oxide compound). The combination of acyl phosphine oxide-based photo polymerization initiator and the thioxanthone photo polymerization initiator tends to be more excellent in a curing process using a UV-LED and have more excellent curability of the ink composition.

The acryl phosphine oxide-based photo polymerization initiator is not particularly limited, however, includes more specifically bis(2,4,6-trimethyl benzoyl)-phenyl phosphine oxide, 2,4,6-trimethyl benzoyl-diphenyl-phosphine oxide, bis-(2,6-dimethoxy benzoyl)-2,4,4-trimethylpentyl phosphine oxide, and the like.

A commercially available acyl phosphine oxide-based photo polymerization initiator is not particularly limited, however, includes, for example, IRGACURE 819 (bis(2,4,6-trimethyl benzoyl)-phenyl phosphine oxide), DAROCUR TPO (2,4,6-trimethyl benzoyl-diphenyl-phosphine oxide), and the like.

Specific examples of the photo-radical polymerization initiator are not particularly limited, however, include, for example, acetophenone, acetophenone benzyl ketal, 1-hydroxy cyclohexyl phenyl ketone, 2,2-dimethoxy-2-phenyl acetophenone, xanthone, fluorenone, benzaldehyde, fluorene, anthraquinone, triphenylamine, carbazole, 3-methylacetophenone, 4-chlorobenzophenone, 4,4'-dimethoxybenzophenone, 4,4'-diaminobenzophenone, Michler's ketone, benzoin propyl ether, benzoin ethyl ether, benzyl dimethyl ketal, 1-(4-isopropyl-phenyl)-2-hydroxy-2-methylpropane-1-one, 2-hydroxy-2-methyl-1-phenyl propane-1-one, and 2-methyl-1-[4-(methylthio)phenyl]-2-morpholino-propane-1-one.

A commercially available photo-radical polymerization initiator is not particularly limited, however, includes, for example, IRGACURE 651 (2,2-dimethoxy-1,2-diphenylethane-1-one), IRGACURE 184 (1-hydroxy-cyclohexyl-phenyl-ketone), DAROCUR 1173 (2-hydroxy-2-methyl-1-phenyl-propane-1-one), IRGACURE 2959 (1-[4-(2-hydroxyethoxy)-phenyl]-2-hydroxy-2-methyl-1-propane-1-one), IRGACURE 127 (2-hydroxy-1-{4-[4-(2-hydroxy-2-methyl-propionyl)-benzyl]-phenyl}-2-methyl-propane-1-one}, IRGACURE 907 (2-methyl-1-(4-methyl thio phenyl)-2-morpholino propane-1-one), IRGACURE 369 (2-benzyl-2-dimethyl amino-1-(4-morpholino phenyl)-butanone-1), IRGACURE 379 (2-(dimethylamino)-2-[(4-methylphenyl) methyl]-1-[4-(4-morpholinyl)phenyl]-1-butanone), IRGACURE 784 (bis(η5-2,4-cyclopentadien-1-yl)-bis(2,6-difluoro-3-(1H-pyrrol-1-yl)-phenyl)-titanium), IRGACURE OXE 01 (1.2-octanedione,1-[4-(phenyl thio)-,2-(O-benzoyloxime)]), IRGACURE OXE 02 (ethanone,1-[9-ethyl-6-(2-methylbenzoyl)-9H-carbazol-3-yl]-,1-(O-acetyloxime)), IRGACURE 754 (a mixture of oxy-phenyl acetic acid, 2-[2-oxo-2-phenyl acetoxy ethoxy] ethyl ester and oxy phenyl acetic acid, and 2-(2-hydroxy ethoxy) ethyl ester) (the above are manufactured by BASF Corp.), Speedcure TPO (the above is manufactured by Lambson, Inc.), Lucirin TPO, LR8893, LR8970 (the above are manufactured by BASF Corp.), and Ubecryl P36 (manufactured by UCB, Inc.).

The photo polymerization initiators may be used as one type alone, or in combination of two or more types.

The content of the photo polymerization initiator is preferably 5 to 20 mass % with respect to the total mass of the ink composition (100 mass %). When the content is in this range, the UV rays can quickly and fully perform the curing and it is possible to avoid a coloring caused by the remaining undissolved photo polymerization initiator or the photo polymerization initiator.

Polymerization Inhibitor

A polymerization inhibitor included in the ink composition of the embodiment is not limited to the following, however, includes, for example, a hindered amine compound, p-methoxyphenol, hydroquinone monomethyl ether (MEHQ), hydroquinone, cresol, t-butylcatechol, 3,5-di-t-butyl-4-hydroxytoluene, 2,2'-methylenebis(4-methyl-6-t-butylphenol), 2,2'-methylenebis(4-ethyl-6-butylphenol), and 4,4'-thiobis(3-methyl-6-t-butyl phenol).

The hindered amine compound, for example, is not limited to the following, however, includes, for example, a compound having a 2,2,6,6-tetramethylpiperidine-N-oxyl-skeleton, a compound having a 2,2,6,6-tetramethylpiperidine-skeleton, a compound having a 2,2,6,6-tetramethylpiperidine-N-alkyl-skeleton, a compound having a 2,2,6,6-tetramethylpiperidine-N-acyl-skeleton, and the like.

A commercially available hindered amine compound includes ADK STAB LA-7RD (2,2,6,6-tetramethyl-4-hydroxypiperidine-1-oxyl) (a brand name of ADEKA Corp.), IRGASTAB UV 10 (4,4'-[1,10-dioxo-1,10-decanediyl)bis(oxy)]bis[2,2,6,6-tetramethyl]-1-piperidinyloxy) (CAS.2516-92-9), TINUVIN 123 (4-hydroxy-2,2,6,6-tetramethylpiperidine-N-oxyl) (the above, brand names of BASF Corp.), FA-711HM, FA-712HM (2,2,6,6-tetramethyl piperidinyl methacrylate, brand names of Hitachi Chemical Co., Ltd.), TINUVIN 111FDL, TINUVIN 144, TINUVIN 152, TINUVIN 292, TINUVIN 765, TINUVIN 770DF, TINUVIN 5100, SANOL LS-2626, CHIMASSORB 119FL, CHIMASSORB 2020 FDL, CHIMASSORB 944 FDL, TINUVIN 622 LD (the above, brand names of BASF Corp.), LA-52, LA-57, LA-62, LA-63P, LA-68LD, LA-77Y, LA-77G, LA-81, LA-82 (1,2,2,6,6-pentamethyl-4-piperidyl methacrylate), and LA-87 (the above, brand names of ADEKA Corp.).

Among the commercially available products, LA-82 is a compound having a 2,2,6,6-tetramethylpiperidine-N-methyl-skeleton, and ADK STAB LA-7RD and IRGASTAB UV 10 are compounds having a 2,2,6,6-tetramethylpiperidine-N-oxyl-skeleton.

Among the above, a compound having a 2,2,6,6-tetramethylpiperidine-N-oxyl-skeleton is preferred since this can make the storage stability of an ink more excellent while maintaining an excellent curability.

Specific examples of the compound having a 2,2,6,6-tetramethylpiperidine-N-oxyl-skeleton are not limited to the following, however, include 2,2,6,6-tetramethyl-4-hydroxy piperidine-1-oxyl, 4,4'-[1,10-dioxo-1,10-decanediyl)bis(oxy)]bis[2,2,6,6-tetramethyl]-1-piperidinyloxy, 4-hydroxy-2,2,6,6-tetramethylpiperidine-N-oxyl, bis(1-oxyl-2,2,6,6-tetramethyl-piperidine-4-yl) sebacate, and decanedioate bis(2,2,6,6-tetramethyl-1-(octyloxy)-4-piperidinyl)ester.

The hindered amine compounds may be used as one type alone, or in combination of two or more types.

In general, by including the polymerization inhibitor in the ink composition, it is possible to secure the storage stability of the ink composition even when an amount of dissolved oxygen is low. However, a black pigment and a yellow pigment have a strong tendency to absorb a portion of the active radiation (particularly, ultraviolet region) compared to other pigments such as a cyan pigment, a magenta pigment, and the like. Thus, there may not be enough energy for completely curing a coating film of the black ink and/or the yellow ink discharged on a recording medium even though the active radiation is irradiated, so that only the vicinity of the surface of the coating film is cured and the interior of the coating film is incompletely cured. Therefore, there is a case where time is required in curing. An uncured ink composition which is in the coating film irregularly flows and the like before being cured, and thereby aggregation spots (gloss unevenness) occur. Therefore, when the polymerization inhibitor is included in the black ink and the yellow ink, there is a possibility that the ink is more unlikely to be cured by the polymerization inhibitor, and the frequency of occurrence of the aggregation spots becomes higher. Therefore, in the black ink and the yellow ink, the content of the polymerization inhibitor is preferably equal to or less than 0.05 mass % (500 ppm), and is more preferably 0.02 mass % (200 ppm) with respect to the total mass (100 mass %) of the ink composition.

The polymerization inhibitors may be used as one type alone, or the polymerization inhibitors may be used in combination of two or more types.

Polymerizable Compound

The ink composition may also include a polymerizable compound. The polymerizable compound is polymerized alone or by the operation of the photo polymerization initiator during light irradiation, and thereby it is possible to cure the printed ink composition. The polymerizable compound is not particularly limited, however, specifically a monofunctional, a difunctional, a trifunctional or greater, and polyfunctional monomers and oligomers, which are well known, can be used as the polymerizable compound. The polymerizable compound may be used as one type alone, or may be used in combination of two or more types. The polymerizable compound will be exemplified below.

The monofunctional, the difunctional, the trifunctional or greater, and the polyfunctional monomers are not particularly limited, however, include, for example, an unsaturated carboxylic acid such as (meth)acrylic acid, itaconic acid, crotonic acid, maleic acid, and isocrotonic acid; a salt of an unsaturated carboxylic acid, esters of an unsaturated carboxylic acid, urethane, amides and anhydrides; acrylonitrile, styrene, various unsaturated polyesters, unsaturated polyethers, unsaturated polyamides, and unsaturated urethane. Moreover, the monofunctional, the difunctional, the trifunctional or greater, and the polyfunctional oligomers include, for example, oligomers formed from monomers such as straight-chain acrylic oligomers, epoxy (meth)acrylates, oxetane (meth)acrylates, aliphatic urethane (meth) acrylates, aromatic urethane (meth)acrylates and polyester (meth)acrylates.

In addition, other monofunctional monomers and polyfunctional monomers may include an N-vinyl compound. The N-vinyl compound is not particularly limited, however, includes, for example, N-vinyl formamide, N-vinyl carbazole, N-vinyl acetamide, N-vinylpyrrolidone, N-vinyl caprolactam, acryloyl morpholine, and derivatives of these.

Among the polymerizable compounds, (meth)acrylic acid esters, that is, (meth)acrylates are preferred.

The monofunctional (meth)acrylate is not particularly limited, however, includes, for example, isoamyl (meth) acrylate, stearyl (meth)acrylate, lauryl (meth)acrylate, octyl (meth)acrylate, decyl (meth)acrylate, isomyristyl (meth) acrylate, isostearyl (meth)acrylate, 2-ethylhexyl-di glycol (meth)acrylate, 2-hydroxybutyl (meth) acrylate, butoxyethyl (meth)acrylate, ethoxy diethylene glycol(meth)acrylate, methoxy diethylene glycol(meth)acrylate, methoxy polyethylene glycol(meth)acrylate, methoxy propylene glycol (meth) acrylate, phenoxyethyl (meth) acrylate, tetrahydrofurfuryl(meth)acrylate, isobornyl(meth)acrylate, 2-hydroxyethyl(meth)acrylate, 2-hydroxypropyl(meth)acrylate, 2-hydroxy-3-phenoxypropyl(meth)acrylate, lactone-modified flexible(meth)acrylate, t-butyl cyclohexyl (meth) acrylate, dicyclopentanyl(meth)acrylate, and dicyclopentenyloxyethyl(meth)acrylate. Among these, phenoxyethyl (meth)acrylate is preferred.

The content of the monofunctional (meth)acrylate is preferably 30 to 85 mass %, and is more preferably 40 to 75 mass % with respect to the total mass of the ink composition (100 mass %). In the preferable range, curability, initiator solubility, storage stability, and discharge stability tend to become more excellent.

A monofunctional (meth)acrylate also includes those containing a vinyl ether group. The monofunctional (metal) acrylate is not particularly limited, however, includes, for example, 2-vinyloxyethyl (meth)acrylate, 3-vinyloxypropyl (meth) acrylate, 1-methyl-2-vinyloxyethyl (meth) acrylate, 2-vinyloxypropyl (meth) acrylate, 4-vinyloxybutyl (meth) acrylate, 1-methyl-3-vinyloxypropyl (meth) acrylate, 1-vinyloxymethylpropyl (meth) acrylate, 2-methyl-3-vinyloxypropyl (meth) acrylate, 1,1-dimethyl-2-vinyloxyethyl (meth) acrylate, 3-vinyloxybutyl (meth) acrylate, 1-methyl-2-vinyloxypropyl (meth) acrylate, 2-vinyloxybutyl (meth) acrylate, 4-vinyloxycyclohexyl (meth) acrylate, 6-vinyloxyhexyl (meth)acrylate, 4-vinyloxymethylcyclohexylmethyl (meth) acrylate, 3-vinyloxymethylcyclohexylmethyl (meth) acrylate, 2-vinyloxymethylcyclohexylmethyl (meth) acrylate, p-vinyloxymethylphenylmethyl (meth) acrylate, m-vinyloxymethylphenylmethyl (meth) acrylate, o-vinyloxymethyl phenylmethyl (meth) acrylate, 2-(vinyloxyethoxy) ethyl (meth)acrylate, 2-(vinyloxy isopropoxy)ethyl (meth) acrylate, 2-(vinyloxyethoxy)propyl (meth) acrylate, 2-(vinyloxyethoxy)isopropyl (meth)acrylate, 2-(vinyloxy isopropoxy)propyl (meth) acrylate, 2-(vinyloxy isopropoxy) isopropyl (meth)acrylate, 2-(vinyloxyethoxy)ethyl (meth) acrylate, 2-(vinyloxyethoxy isopropoxy)ethyl (meth) acrylate, 2-(vinyloxy isopropoxyethoxy)ethyl (meth)acrylate, 2-(vinyloxy isopropoxy isopropoxy)ethyl (meth) acrylate, 2-(vinyloxyethoxyethoxy)propyl (meth) acrylate, 2-(vinyloxyethoxy isopropoxy)propyl (meth) acrylate, 2-(vinyloxy isopropoxyethoxy)propyl (meth)acrylate, 2-(vinyloxy isopropoxyisopropoxy)propyl (meth) acrylate, 2-(vinyloxyethoxy ethoxy) isopropyl (meth) acrylate, 2-(vinyloxyethoxy isopropoxy)isopropyl (meth) acrylate, 2-(vinyloxy isopropoxyethoxy)isopropyl (meth)acrylate, 2-(vinyloxy isopropoxyisopropoxy)isopropyl (meth) acrylate, 2-(vinyloxyethoxyethoxyethoxy)ethyl (meth) acrylate, 2-(vinyloxyethoxyethoxyethoxyethoxy)ethyl (meth)acrylate, 2-(isopropenoxy ethoxy)ethyl (meth)acrylate, 2-(isopropenoxy ethoxy ethoxy)ethyl (meth)acrylate, 2-(isopropenoxy ethoxyethoxyethoxy)ethyl (meth) acrylate, 2-(isopropenoxy ethoxyethoxyethoxyethoxy)ethyl (meth) acrylate, polyethylene glycol monovinyl ether (meth)acrylate, polypropylene glycol monovinyl ether (meth)acrylate, phenoxyethyl (meth)acrylate, isobornyl (meth)acrylate, and benzyl (meth) acrylate. Among these, 2-(vinyloxyethoxy)ethyl (meth) acrylate, phenoxyethyl (meth) acrylate, isobornyl (meth) acrylate, and benzyl (meth)acrylate are preferred.

Among these, since the ink can have lower viscosity, a higher flash point, and an excellent curability, 2-(vinyloxyethoxy)ethyl (meth)acrylate, that is, at least any one of 2-(vinyloxyethoxy)ethyl acrylate and 2-(vinyloxyethoxy) ethyl methacrylate, is preferred, and 2-(vinyloxyethoxy) ethyl acrylate is more preferred. Both 2-(vinyloxyethoxy) ethyl acrylate and 2-(vinyloxyethoxy)ethyl methacrylate have a simple structure and have a small molecular weight, so that it is possible to remarkably lower the viscosity of the ink. 2-(vinyloxyethoxy)ethyl (meth)acrylate includes 2-(2-vinyloxyethoxy)ethyl (meth)acrylate and 2-(1-vinyloxyethoxy)ethyl (meth)acrylate. 2-(vinyloxyethoxy)ethyl acrylate includes 2-(2-vinyloxyethoxy)ethyl acrylate and 2-(1-vinyloxyethoxy)ethyl acrylate. 2-(vinyloxyethoxy)ethyl acrylate is more excellent in the curability than 2-(vinyloxyethoxy)ethyl (meth) acrylate.

The content of the vinyl ether group-containing (meth) acrylic acid esters, in particular, 2-(vinyloxyethoxy)ethyl (meth)acrylate is preferably 10 to 70 mass %, and is more preferably 30 to 50 mass % with respect to the total mass (100 mass %) of the ink composition. When the content is equal to or more than 10 mass %, the viscosity of the ink can be lowered and the curability of the ink can become more excellent. On the other hand, when the content is equal to or less than 70 mass %, the storage stability of the ink can be maintained in an excellent state.

Among the (meth)acrylates, the difunctional (meth)acrylate includes, for example, triethylene glycol di(meth)acrylate, tetraethylene glycol di(meth)acrylate, polyethylene glycol di(meth)acrylate, dipropylene glycol di(meth)acrylate, tripropylene glycol di(meth)acrylate, polypropylene glycol di(meth)acrylate, 1,4-butanediol di(meth)acrylate, 1,6-hexanediol di(meth)acrylate, 1,9-nonanediol di(meth)acrylate, Neopentyl glycol di(meth)acrylate, dimethylol-tricyclodecanedi(meth)acrylate, Bisphenol A EO (ethylene oxide) adduct di(meth)acrylate, Bisphenol A PO (propylene oxide) adduct di(meth)acrylate, hydroxy pivalic acid neopentyl glycol di(meth)acrylate, poly tetramethylene glycol di(meth)acrylate, diethylene glycol di(meth)acrylate, triethylene glycol di(meth)acrylate, and trifunctional or greater (meth)acrylates having a pentaerythritol skeleton or dipentaerythritol skeleton. Among these, dipropylene glycol di(meth)acrylate is preferred. Among these, dipropylene glycol di(meth)acrylate, tripropylene glycol di(meth)acrylate, diethylene glycol di(meth)acrylate, triethylene glycol di(meth)acrylate, and trifunctional or greater (meth)acrylates having a pentaerythritol-skeleton or dipentaerythritol-skeleton are preferred. It is preferable that the ink composition include the polyfunctional (meth)acrylate in addition to the monofunctional (meth) acrylate.

The content of the difunctional or greater polyfunctional (meth)acrylate is preferably 5 to 60 mass %, is more preferably 15 to 60 mass %, and is further more preferably 20 to 50 mass % with respect to the total mass (100 mass %)

of the ink composition. In the preferable range, the curability, storage stability, and the discharge stability tend to be more excellent.

Among the (meth)acrylates, a trifunctional or greater polyfunctional (meth)acrylate includes, for example, trimethylolpropane tri(meth)acrylate, EO-modified trimethylolpropane tri(meth)acrylate, pentaerythritol tri(meth)acrylate, pentaerythritol tetra(meth)acrylate, dipentaerythritol hexa (meth)acrylate, ditrimethylolpropane tetra(meth)acrylate, glycerin propoxy tri(meth)acrylate, caprolactone-modified trimethylolpropane tri(meth)acrylate, pentaerythritolethoxy tetra(meth)acrylate, and caprolactam modified dipentaerythritol hexa(meth)acrylate.

Among these, it is preferable that the polymerizable compound include the monofunctional (meth) acrylate.

In this case, the ink composition has a low viscosity, the solubility of the photopolymerization initiator and other additives becomes excellent, and the discharge stability during an ink jet recording is easily obtained. Furthermore, the toughness, heat resistance, and chemical resistance of the coating film are increased, so that it is more preferable to jointly use both the monofunctional (meth)acrylate and the difunctional (meth)acrylate together, and it is further more preferable to jointly use both phenoxy ethyl (meth)acrylate and dipropylene glycol di(meth)acrylate.

The content of the polymerizable compound is preferably 5 to 95 mass %, and is more preferably 15 to 90 mass % with respect to the total mass (100 mass %) of the ink composition. When the content of the polymerizable compound is in the range, the viscosity and the odor can be reduced, and the solubility and the reactivity of the photo polymerization initiator can be more excellent.

Color Material

The ink composition may further include a color material. A pigment can be used as the color material.

By using the pigment as the color material, it is possible to improve the light resistance of the ink composition. An inorganic pigment or an organic pigment can be used as the pigment.

As the inorganic pigment, it is possible to use a carbon black (C. I. pigment black 7) type such as a furnace black, a lamp black, an acetylene black, a channel black, and the like, iron oxide, and titanium oxide.

The organic pigment includes an azo pigment such as an insoluble azo pigment, condensed azo pigment, azo lake pigment, chelate azo pigment, and the like, a polycyclic pigment such as a phthalocyanine pigment, perynone or perylene pigment, anthraquinone pigment, quinacridone pigment, dioxane pigment, thio indigo pigment, isoindoline pigment, quinophthalone pigment, and the like, dye chelates (for example, basic dye chelates, acidic dye chelates, and the like), color lakes (basic dye type lake, acid dye type lake), a nitro pigment, a nitroso pigment, an aniline black pigment, and a daylight fluorescent pigment.

More specifically, the carbon black used in the black ink includes No. 2300, No. 900, MCF88, No. 33, No. 40, No. 45, No. 52, MA7, MA8, MA100, No. 2200B, and the like (the above are manufactured by Mitsubishi Chemical Corporation (Mitsubishi Chemical Corporation), Ltd.), Raven 5750, Raven 5250, Raven 5000, Raven 3500, Raven 1255, Raven 700, and the like (the above are manufactured by Columbia Carbon (Carbon Columbia) Co., Ltd.), Regal 400R, Regal 330R, Regal 660R, Mogul L, Monarch 700, Monarch 800, Monarch 880, Monarch 900, Monarch 1000, Monarch 1100, Monarch 1300, Monarch 1400, and the like (Cabot Corporation (CABOT JAPAN K.K.) Co., Ltd.), Color Black FW1, Color Black FW2, Color Black FW2V, Color Black FW18, Color Black FW200, Color Black S150, Color Black 5160, Color Black 5170, Printex 35, Printex U, Printex V, Printex 140U, Special Black 6, Special Black 5, Special Black 4A, and Special Black 4 (the above are manufactured by Degussa (Degussa) Co. Ltd.).

The pigment used in a white ink includes C. I. Pigment White 6, 18, 21, and the like.

The pigment used in a yellow ink includes C. I. Pigment yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172, 180, and the like.

The pigment may be used as one type alone, or may be jointly used as two or more types.

When using the pigment, the average particle diameter is preferably equal to or less than 300 nm, and is more preferably 50 to 200 nm. When the average particle diameter is in the range, the reliability such as the discharge stability and the dispersibility stability in the ink composition can be more excellent and an image with an excellent image quality can be formed. The average particle diameter in this description is measured by a dynamic light scattering method.

The content of color material is preferably 1 to 20 mass % with respect to the total mass (100 mass %) of the ink composition since an excellent hindering property and color reproducibility are provided.

Dispersant

When the ink composition includes a pigment, a dispersant may be further included to make the pigment dispersibility more excellent. The dispersant is not particularly limited, however, includes, for example, a dispersant commonly used in the preparation of the pigment dispersion like polymer dispersant. Specific examples of the dispersant include a dispersant which has one type or more as a main component among polyoxyalkylene polyalkylene polyamine, vinyl polymers and copolymers, acrylic polymers and copolymers, polyester, polyamide, polyimide, polyurethane, amino-based polymers, silicon-containing polymers, sulfur-containing polymers, fluorine-containing polymers, and an epoxy resin. A commercially available polymer dispersant includes Horse Mackerel Spar series by Ajinomoto Fine-Techno Co., Inc., Sol Spurs series (Solsperse 36000, and the like) providable by Avecia (Avecia) Corp. and Noveon (Noveon) Corp., Disperbyk series of BYK Chemie Inc., and Disparlon series of Kusumoto Chemicals Co., Ltd.

Other Additives

The ink composition may include additives (components) other than those mentioned above. Such components are not particularly limited, however, include, for example, a slip agent (surfactant), a polymerization accelerator, a penetration enhancer, and a wetting agent (humectant) which are well-known, and other additives. Other additives described above include, for example, a fixing agent, an antifungal agent, a preservative, an antioxidant, UV ray absorbers, a chelating agent, a pH adjusting agent, and a thickener which are well known.

Raw Materials Used in the Embodiment

Raw materials used in the printer 1 according to the embodiment are as follows.

Color Material

C. I. Pigment Black 7 (Microlith Black C-K (brand name), BASF Corp.)

Dispersant

Solsperse 36000 (brand name of Noveon Corp.)

Vinyl Ether Group-Containing (Meth)Acrylic Acid Esters

VEEA (2-(2-vinyloxyethoxy)ethyl acrylate, a brand name of Nippon Shokubai Corp.)

Polymerizable Compounds Other Than the Above

Viscoat #192 (phenoxyethyl acrylate, brand name of Osaka Organic Chemical Industry (OSAKA ORGANIC CHEMICAL INDUSTRY LTD.))

SR508 (Dipropylene glycol acrylate, brand name of Sartomer Company)

Photo Polymerization Initiator

DAROCURE TPO (brand name of BASF Corp., solid content 100%)

IRGACURE 369 (brand name of BASF Corp., solid content 100%)

Speedcure DETX (brand name of Lambson Inc., solid content 100%)

Speedcure ITX (brand name of Lambson Inc., solid content 100%)

Ink Supply Unit 45

Figure 3:
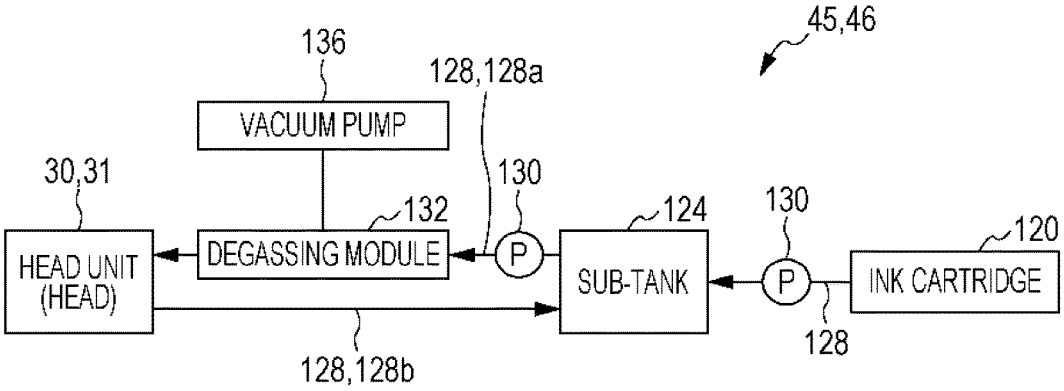
FIG. 3 is a block diagram of an ink supply unit.
Figure 4:
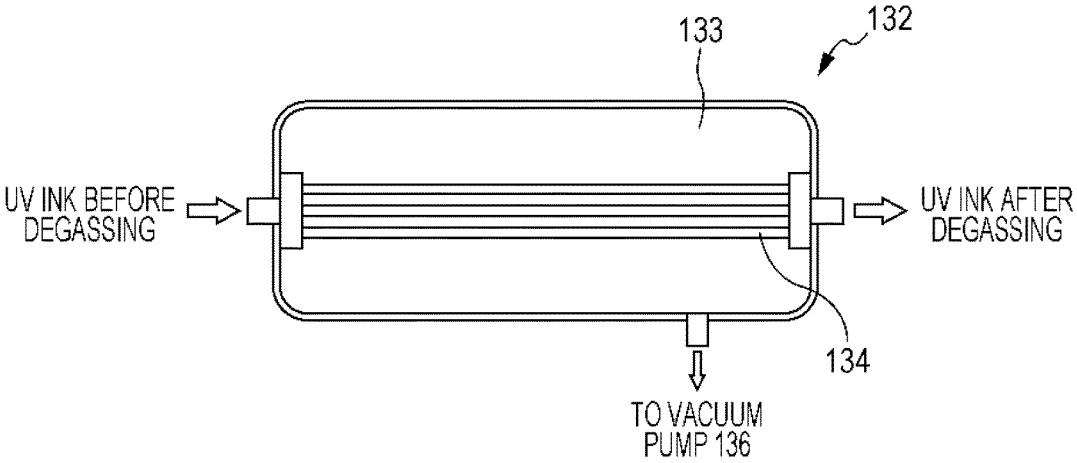
FIG. 4 is a schematic diagram of a degassing module.

FIG. 3 is a block diagram of an ink supply unit 45. FIG. 4 is a schematic diagram of a degassing module 132.

The ink supply unit 45, as described above, supplies a UV ink to the head unit 30 (head 31) when an amount of the UV ink in the head unit 30 (head 31) is reduced due to the discharge of the UV ink by the head 31.

The ink supply unit 45 is provided for each color of the UV ink. That is, a yellow ink supply unit for supplying the UV ink of a yellow color, a magenta ink supply unit for supplying the UV ink of a magenta color, a cyan ink supply unit for supplying the UV ink of a cyan color, a black ink supply unit 46 for supplying the UV ink of a black ink, and the like are provided.

All of the supply units have the same configuration, so that the black ink supply unit 46 will be mainly described among the plurality of these ink supply units 45 in the following.

The black ink supply unit 46, as shown in FIG. 3, has an ink cartridge 120, a sub-tank 124 as an example of an ink container which stores the UV ink to be supplied to the head unit 30 (head 31), a large number of tubes 128 which are the flow paths (path) of the UV ink, a liquid feeding pump 130, a degassing module 132, and a vacuum pump 136.

The ink cartridge 120 accommodates the UV ink to be supplied to the head unit 30. The ink cartridge 120 is configured to be detachable from the printer 1.

In addition, the ink cartridge 120 is connected to the sub-tank 124 through the tube 128 which connects the ink cartridge 120 and the sub-tank 124. A liquid feeding pump 130 for sending the UV ink from the ink cartridge 120 to the sub-tank 124 is attached to the tube 128.

The sub-tank 124 temporarily stores the UV ink supplied to the head unit 30 (head 31) from the ink cartridge 120. The sub-tank 124 is fixed to the printer 1. That is, unlike the ink cartridge 120, the sub-tank 124 is configured not to be detachable from the printer 1.

In addition, the sub-tank 124 is connected to the head unit 30 (head 31) through the reciprocating tube 128 (for convenience, referred to as an outgoing tube 128*a* and a returning tube 128*b*) which connects the sub-tank 124 and the head unit 30 (head 31). That is, in the embodiment, an ink circulation flow path, which is formed so that the UV ink supplied from the sub-tank 124 returns back to the sub-tank 124 and is connected to the head unit 30 (head 31), is formed by the outgoing tube 128*a* and the returning tube 128*b*. Then, a/the liquid feeding pump 130 for sending the UV ink from the sub-tank 124 to the head unit 30 (head 31) and circulating the UV ink is attached to the outgoing tube 128*a*.

In addition, in the middle of the ink circulation flow path (specifically, the outgoing tub 128*a*), the degassing module 132 is provided. The degassing module 132 removes air from the UV ink so as to suppress the occurrence of air bubbles in the UV ink.

The degassing module 132 has a vacuum chamber 133 and a gas-permeable membrane 134 of a tube shape. That is, in the degassing module 132, as shown in FIG. 4, a plurality of gas-permeable membranes 134 are provided in the vacuum chamber 133, and the UV ink is allowed to flow in the gas-permeable membranes 134.

Then, when the inside of the vacuum chamber 133 is negative-pressured by the operation of a vacuum pump 136 to be described later, air included in the UV ink flowing in the gas permeable membranes 134 goes out of the gas-permeable membranes 134 due to the pressure difference between the inside and the outside of the gas-permeable membranes 134. Then, by doing so, the air is removed from the UV ink.

The vacuum pump 136 causes the inside of the vacuum chamber 133 to be negative-pressured. The vacuum pump 136 is connected to the degassing module 132. In addition, the vacuum pump 136 according to the embodiment is a vacuum pump which causes the degree of negative pressure (hereinafter, referred to as the degree of vacuum) of the vacuum chamber 133 to be at −85 kPa gauge pressure.

However, in the embodiment, the degree of vacuum is not set to −85 kPa, but is set to be in a range −60 kPa to −20 kPa by performing the on/off control of the vacuum pump 136. More specifically, a pressure sensor which obtains the pressure value in the vacuum chamber 133 is provided. When the pressure value is greater than −20 kPa, the vacuum pump 136 is controlled to be on, and when the pressure value is smaller than −60 kPa, the vacuum pump 136 is controlled to be off.

Such control is performed by the controller 60 controlling the vacuum pump 136. Accordingly, in the embodiment, the controller 60 and the vacuum pump 136 corresponding to the vacuum controller control so that the degree of vacuum is −60 kPa to −20 kPa. A reason why the degree of vacuum is set to be −60 kPa to −20 kPa will be described later.

Printing Processing

When the printer 1 starts printing, the roll sheet S is disposed on the transport path in a state of being along the peripheral surface of the transport drum 26. Then, a tension is given to the roll sheet S by the output torque of the feed shaft 201, the winding drive shaft 202, and a second transport roller 28. More specifically, in the feeding portion of the roll sheet S, a predetermined tension is given by the brake torque of the feed shaft 201 according to the roll diameter of the roll sheet S. In a printing region, the torque of the motor (not illustrated) of the second transport roller 28 is controlled so that a tension detected by the tension roller 27 becomes a predetermined tension. In a winding portion, the torque of the motor (not illustrated) of the winding drive shaft 202 is controlled so that a tension detected by the tension roller 29 becomes a predetermined tension. Each tension of these is determined according to the roll diameter of the roll sheet S.

When the printer 1 receives printing data from the computer 110, the controller 60 causes the motor (not illustrated) of the first transport roller 22 to rotate at a fixed speed. As described above, in a state where a tension is given to the roll sheet S, the first transport roller 22 rotates at a fixed speed, and thereby the roll sheet S is transported in the transport direction at the fixed speed. The transport drum 26, by the friction with the roll sheet S, is driven by the transport of the roll sheet S and rotates in an arrow direction (transport direction).

The roll sheet S on the peripheral surface of the transport drum 26 is transported in a transport direction according to the rotation of the transport drum 26. The roll sheet S during the transport is in close contact with the transport drum 26. In the embodiment, since the position of each head 31 is fixed, the roll sheet S moves relative to each head 31 in the transport direction by transporting the roll sheet S in the transport direction.

The controller 60 intermittently discharges the UV ink from the nozzle of each head 31 of the head unit 30 (dot formation operation) based on image data received from the computer 110 while the roll sheet S is transported on the peripheral surface of the transport drum 26. In this manner, dots are formed on the roll sheet S. Furthermore, the controller 60 causes the irradiation with the UV from the irradiation portion 41 of the irradiation unit 40.

When the roll sheet S passes under the cyan ink head 32, the controller 60 discharges a cyan ink onto the roll sheet S from the cyan ink head 32 to print a cyan image. Similarly, when the roll sheet S passes under the magenta ink head 33, the controller 60 discharges a magenta ink onto the roll sheet S from the magenta ink head 33 to print a magenta image, when the roll sheet S passes under the yellow ink head 34, the controller 60 discharges a yellow ink onto the roll sheet S from the yellow ink head 34 to print a yellow image, and when the roll sheet S passes under the black ink head 35, the controller 60 discharges a black ink onto the roll sheet S from the black ink head 35 to print a black image. Accordingly, a color image is printed onto the roll sheet S.

Lastly, the controller 60 irradiates the UV from the irradiation portion 41 to cure each dot on the roll sheet S.

Effectiveness of the Printer 1 in the Embodiment

As described above, the printer 1 according to the embodiment includes the head 31 which discharges the UV ink onto the roll sheet S, the sub-tank 124 which stores the UV ink to be supplied to the head 31, the ink circulation flow path which is formed so that the UV ink supplied from the sub-tank 124 returns back to the sub-tank 124, and connected to the head 31, the degassing module 132 provided in the middle of the ink circulation flow path, and a vacuum controller (the controller 60 and the vacuum pump 136) which controls the degree of vacuum of the degassing module 132. The vacuum controller (the controller 60 and the vacuum pump 136) controls the degree of vacuum so as to be −60 kPa to −20 kPa. Then, the lifetime of a component can be improved by doing so.

As described above, in the related art, in order to suppress the occurrence of air bubbles in the UV ink, there is a case where the degassing module for removing air from the UV ink is provided in the middle of the ink circulation flow path. In this case, the vacuum pump is connected to the degassing module, and the vacuum pump performs a role of causing the inside of the degassing module to be negative-pressured.

However, in an example in the related art, the degree of negative pressure (the degree of vacuum) in the degassing module is the degree of negative pressure (the degree of vacuum) based on the specifications (power) of the vacuum pump (that is, the degree of vacuum is not controlled). More specifically, the degree of negative pressure (the degree of vacuum) based on the specifications (power) of the vacuum pump is −85 kPa, and the degree of negative pressure (the degree of vacuum) in the degassing module is at this value. Then, accordingly, a problem related to the lifetime of a component to be described later occurs.

In the above-described embodiment the degree of vacuum is controlled to be −60 kPa −20 kPa for the following reason.

The reason will be described using FIG. 5. FIG. 5 is a diagram showing a relationship among the degree of vacuum, an amount of dissolved oxygen, and the lifetime of a pump, and is based on experimental results. In the following description, for convenience, a case where the value of the degree of vacuum is small (or negatively large) is referred to as a high degree of vacuum (for example, the degree of vacuum when the degree of vacuum is −85 kPa is higher than the degree of vacuum when the degree of vacuum is −60 kPa).

The higher the degree of vacuum in the degassing module 132 is, of course, the more air is removed from the UV ink. Then, since oxygen is included in the air at a fixed rate, the more air is removed, an amount of oxygen in the UV ink (that is, an amount of dissolved oxygen) gets reduced. That is, as the degree of vacuum gets higher, an amount of dissolved oxygen gets reduced (refer to FIG. 5).

On the other hand, it is known that oxygen impedes radical polymerization in the UV ink. Therefore, when an amount of dissolved oxygen is too small (the smaller the amount is), the radical polymerization of the UV ink is promoted, and the UV ink is heterogenized by the radical polymerization. Then, foreign substances cause the clogging or the wear of the liquid feeding pump 130 described above to shorten the lifetime of the liquid feeding pump 130.

More specifically, when the degree of vacuum of the degassing module 132 is smaller than −60 kPa, a situation that an amount of dissolved oxygen in the UV ink is less than 6 ppm occurs. Then, when an amount of dissolved oxygen is less than 6 ppm, the occurrence of the foreign substances makes the lifetime of the liquid feeding pump 130 remarkably shortened.

In this manner, as the degree of vacuum in the degassing module 132 gets higher, the lifetime of the liquid feeding pump 130 gets shortened. The inventor has performed an experiment to acquire the lifetime of the liquid feeding pump 130 by changing the degree of vacuum (the experiment was performed on the UV ink of black color and the UV ink of yellow color and similar results were obtained; the experimental result shown in FIG. 5 is a result for a black color). According to the experimental results shown in FIG. 5, when the degree of vacuum is −85 kPa, it is known that the lifetime of the liquid feeding pump 130 is remarkably shortened. On the other hand, when the degree of vacuum is equal to or less than −60 kPa, an amount of dissolved oxygen exceeds 6 ppm, and the lifetime of the liquid feeding pump 130 is significantly increased. Therefore, in the embodiment, the degree of vacuum is set to −60 kPa or less. When the degree of vacuum is −60 kPa, the lifetime of the liquid feeding pump 130 becomes 2000 hours. This is a time considered necessary for guaranteeing the movement of the liquid feeding pump 130 for one year, and is evaluated as a reasonable time.

According to the experimental results shown in FIG. 5, an amount of dissolved oxygen when the degree of vacuum is −10 kPa is the same as an amount of dissolved oxygen when the degree of vacuum is 0 kPa (that is, when the vacuum pump 136 does not operate). Then, this informs that when the degree of vacuum is −10 kPa, a degassing function is not appropriately performed. Therefore, in the embodiment, the degree of vacuum is set to −20 kPa or more.

Moreover, as described above, when adding the polymerization inhibitor in the UV inks of black color and yellow color, there is a problem that agglomeration irregularities occur. Therefore, there is an upper limit in the amount of the polymerization inhibitor to be included in the UV ink. More specifically, it is desirable that the content of the polymerization inhibitor be equal to or less than 500 ppm. On the other hand, in the UV inks of other colors, there is not such a situation, so that it is possible to increase the content of the polymerization inhibitor.

Thus, the experiment was performed on the UV inks of black color and yellow color, and the degree of vacuum was set to −60 kPa or less. However, since more polymerization inhibitor can be added in other colors, it is possible to further increase the degree of vacuum (but, of course, the degree of vacuum may be set to −60 kPa or less). Therefore, the invention is particularly effective for the UV inks of black color and yellow color (the effect of improving the lifetime of the liquid feeding pump 130 is more effectively achieved).

In the experiment, an amount of dissolved oxygen is measured using gas chromatography Agilent 6890 (manufactured by Agilent Technologies). In addition, the content of the polymerization inhibitor is set to 200 ppm.

Other Embodiments

The embodiments described above facilitate the understanding of the invention, and do not make an interpretation by limiting the invention. The invention, without departing from the scope thereof as defined by the claims, can be changed and improved. In particular, the embodiment described below is included in the invention.

In the embodiment described above, a line head is adopted as a discharge head, but a serial head which scans in a direction intersecting with the transport direction of the recording medium may be also used.

In addition, in the embodiment described above, an example of the recording medium includes the roll sheet S, however the recording medium is not limited thereto. The recording medium may be single paper sheet. Moreover, this is not limited to paper, but may be a film or a fabric, for example.

Furthermore, in the embodiment described above, the sub-tank 124 is described as an example of the ink container. That is, there is an example described in which an intermediate container is between the ink cartridge 120 and the head 31, however, the invention is not limited thereto. For example, there may be an example in which the sub-tank 124 is not present (in this case, the ink cartridge 120 corresponds to the ink container).

In addition, in the embodiment described above, the controller 60 and the vacuum pump 136 are described as an example of the vacuum controller, and the controller 60 performs the on/off control of the vacuum pump 136 based on the obtained pressure value of the pressure sensor, however, the invention is not limited thereto. For example, by providing a vacuum regulator on the output side of the vacuum pump 136, the settings of the vacuum regulator may be made so that the degree of vacuum is −60 kPa to −20 kPa (in this case, the vacuum regulator and the vacuum pump 136 correspond to the vacuum controller).

This application is a Continuation of U.S. application Ser. No. 14/206,003 filed Mar. 12, 2014, which is expressly incorporated herein by reference. U.S. patent application Ser. No. 14/206,003 claims the benefit of and priority to Japanese Patent Application No. 2013-058426, filed Mar. 21, 2013, the contents of which are hereby incorporated by reference in its entirety.

What is claimed is:

1. A recording apparatus comprising:

a discharge head for discharging a radiation curable ink to a recording medium;

an irradiation unit that irradiates the radiation curable ink having been discharged onto the recording medium with light;

an ink container for storing the radiation curable ink to be supplied to the discharge head;

an ink circulation flow path which is formed so that the radiation curable ink supplied from the ink container returns back to the ink container, and is connected to the discharge head;

a degassing module which is provided in the ink circulation flow path; and a controller for controlling the degassing module, wherein the controller controls the degassing module to cause an amount of dissolved oxygen in the radiation curable ink to be 6 ppm to 9.7 ppm.

2. The recording apparatus according to claim 1, wherein the radiation curable ink is a radical polymerization-type ink.

3. The recording apparatus according to claim 1, wherein equal to or less than 500 ppm of a polymerization inhibitor is included in the radiation curable ink.

4. The recording apparatus according to claim 3, wherein the polymerization inhibitor is a hindered amine compound.

5. The recording apparatus according to claim 4, wherein the radiation curable ink is a black color ink or a yellow color ink.

* * * * *